United States Patent [19]

Simjian

[11] 4,036,219

[45] * July 19, 1977

[54] EXERCISE AND MASSAGING APPARATUS

[76] Inventor: Luther G. Simjian, 7 Laurel Lane, Greenwich, Conn. 06830

[ * ] Notice: The portion of the term of this patent subsequent to June 1, 1993, has been disclaimed.

[21] Appl. No.: 667,634

[22] Filed: Mar. 17, 1976

[51] Int. Cl.[2] ..... A61H 7/00

[52] U.S. Cl. ..... 128/48; 128/57

[58] Field of Search ..... 128/44, 48–52, 128/63, 58, 56, 57; 272/73

[56] References Cited

U.S. PATENT DOCUMENTS

| | | | |
|---|---|---|---|
| 3,861,382 | 1/1975 | Simjian | 128/63 |
| 3,960,144 | 6/1976 | Simjian | 128/58 |

*Primary Examiner*—Lawrence W. Trapp

[57] ABSTRACT

An exercise and massaging apparatus includes a bicycle type structure with pedal means. One or more arms extend vertically from the base of the bicycle and are provided at their respective upper ends with massaging means adapted to engage the torso of the person using the apparatus. Responsive to the operation of the pedal means, the arms with massaging means undergo a reciprocating rotational motion to provide a back and forth massaging action. The apparatus includes a simplified coupling means to disconnect the motion of the arms from the pedal means. The arms include adjusting means for setting the massaging means to the desired height and azimuth location relative to the torso of the person.

24 Claims, 5 Drawing Figures

EXERCISE AND MASSAGING APPARATUS

BRIEF SUMMARY OF THE INVENTION

The therapeutic use of exercise bicycles is well established and documented. These bicycles are recommended for use not only by relatively healthy people but also by persons on their recovery from mild cardiac infarctions. In several previous inventions I have combined the exercising bicycle with a massaging belt for adding a massaging action to the physical effort to which the person subjects himself. A typical arrangement of this type is shown in my co-pending application for U.S. Pat. Ser. No. 594,640 entitled, "Exercise And Massaging Apparatus,"filed July 10, 1975, now U.S. Pat. No. 3,960,144 issued June 1, 1976. The present invention concerns a similar apparatus but differs in two important aspects. First, the massaging belt used heretofore is replaced by massaging means mounted to an arm which undergoes reciprocating rotational motion. The arm is provided with adjusting features in order to permit proper engagement between the massaging means and the torso of a person using the exercising bicycle. Secondly, a greatly simplified mechanical construction has been developed so as to significantly decrease the cost of such a device and make it more suitable for mass production thereby increasing its availability to the public. Still other features of this invention will be clearly apparent from the following description when taken in conjunction with the accompanying drawings.

DETAILED DESCRIPTION OF THE INVENTION

Figure 1:
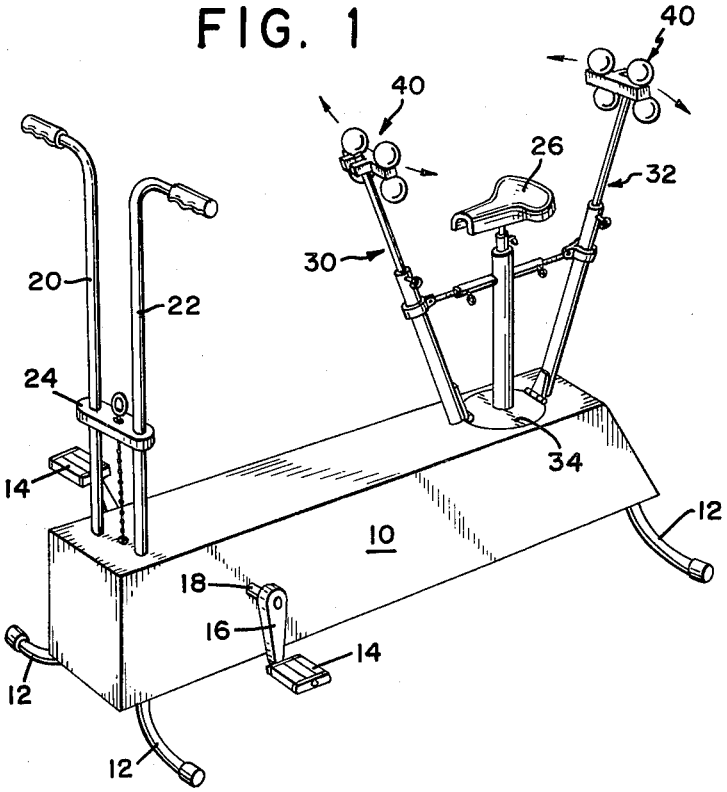
FIG. 1 is a perspective view of the assembled exercise and massaging apparatus.

Referring now to the figures and FIG. 1 in particular, there is shown a stationary base support 10 comprising a rectangular enclosure which rests on a floor or other suitable base by means of a set of outwardly extending legs 12. The support 10 supports, moreover, a pair of pedals 14 which are mounted by suitable crank arms 16 to a pedal shaft 18 journalled in the support 10. In front of the pedal shaft 18 there extend upwardly from the support 10 a set of rods 20 and 22 which are curved over at their respective upper ends to form a pair of stationary handle bars. The bars 20 and 22 are held in alignment by means of a cross bracket 24.

To the rear of the support 10 there is found a stationary seat 26 for accommodating a person operating the pedals 14 while supporting himself at the handle bars 20 and 22. The seat 26 is adjustable along its height by means to be described later. In addition, a pair of arms 30 and 32 extend upwardly from the support 10, each arm being mounted at its respective lower end to a rotatable plate 34 which is adapted to undergo a reciprocating rotational motion about a vertical rotational axis through the center of plate 34. Hence, responsive to the motion of plate 34, the arms 30 and 32 are caused to undergo reciprocating rotational motion about the torso of a person sitting on the seat 26 and if the arms 30 and 32 are adjusted so that the massaging means 40 disposed at the upper end of each arm 30 and 32 are in contact with the person, a back and forth massaging action about the person's torso is experienced. The detailed construction of the drive mechanism for converting the rotating motion applied to the pedal shaft 18 to the reciprocating rotational motion in a horizontal plane manifest at the massaging means 40 will be explained in greater detail with reference to FIGS. 2 and 3. Typically, the reciprocating rotational motion is an arc of 90 degrees.

Figure 2:
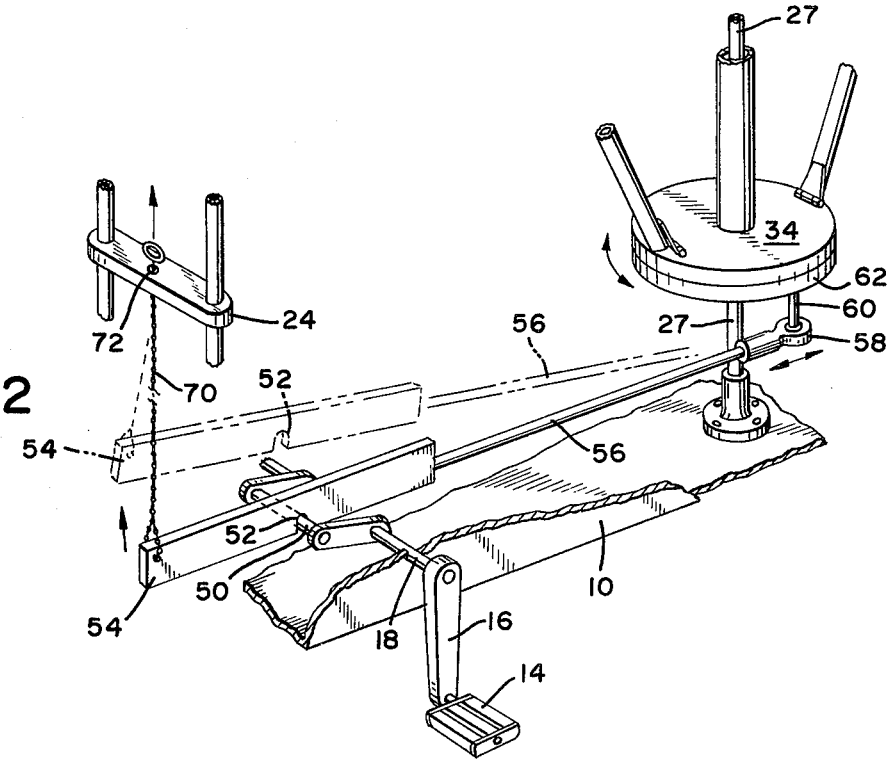
FIG. 2 is a partially sectioned and exploded view of the mechanism contained inside the base support.
Figure 3:
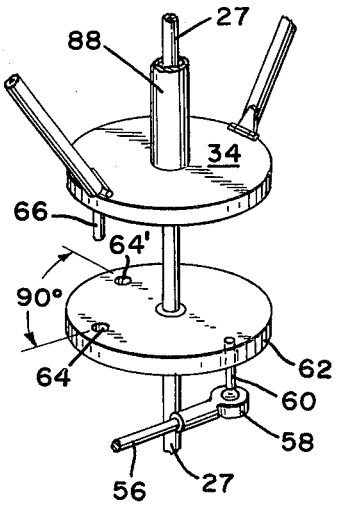
FIG. 3 is a detailed view of the drive mechanism.

Referring now to FIGS. 2 and 3, it will be noted that the pedal shaft 18 is constructed in the form of a crank shaft having a crank pin 50. The crank pin 50 is engaged by the slot 52 disposed in the bar 54. A connecting rod 56 is connected with its left end to the bar 54 and terminates at its right end in a ball and socket joint 58. The ball and socket joint form a universal coupling member in order to accommodate the several motions of the bar 54. A pin 60 is coupled with its lower end to the ball and socket coupling 58 and is coupled with its upper end into the face of a horizontally disposed drive plate 62. It will be apparent that as the pedal shaft 18 rotates, the bar 54, the connecting rod 56 and the coupling 58 undergo a reciprocating motion thereby causing the drive plate 62 to undergo reciprocating rotational motion about the vertical axis through the stationary seat support shaft 27. As seen in FIG. 3, the motion of the drive plate 62 is transferred to an upper rotatable plate 34 by means of an indexing arrangement comprising a suitable aperture 64 in the drive plate 62 and a pin 66 depending from the rotatable plate 34 and engaging the aperture 64. As seen in FIG. 3, several indexing apertures may be provided in order to change the azimuth orientation of the arms 30 and 32 around the torso of the person resting on the seat. A second aperture disposed typically at 90° is identified in FIG. 3 by numeral 64'.

Referring to FIG. 2, in order to uncouple the motion of the arms 30 and 32 with massaging means 40 from the rotation of the pedal shaft 18, a bead chain 70 is fastened to the front end of the bar 54 and upon lifting the bar 54, the slot 52 is lifted from engagement with the crank pin 50, thereby breaking the connection between the massaging means and the pedal shaft. In this way the present apparatus can be used as an exercise apparatus without concomitant operation of the massaging means. The chain 70 is fed through an aperture 72 in the bracket 24 and suitable means, not shown, are provided to retain the bead chain 70 when the bar 54 is in the raised or lifted position. The ball and socket joint 58 accommodates this lifting motion.

Figure 4:
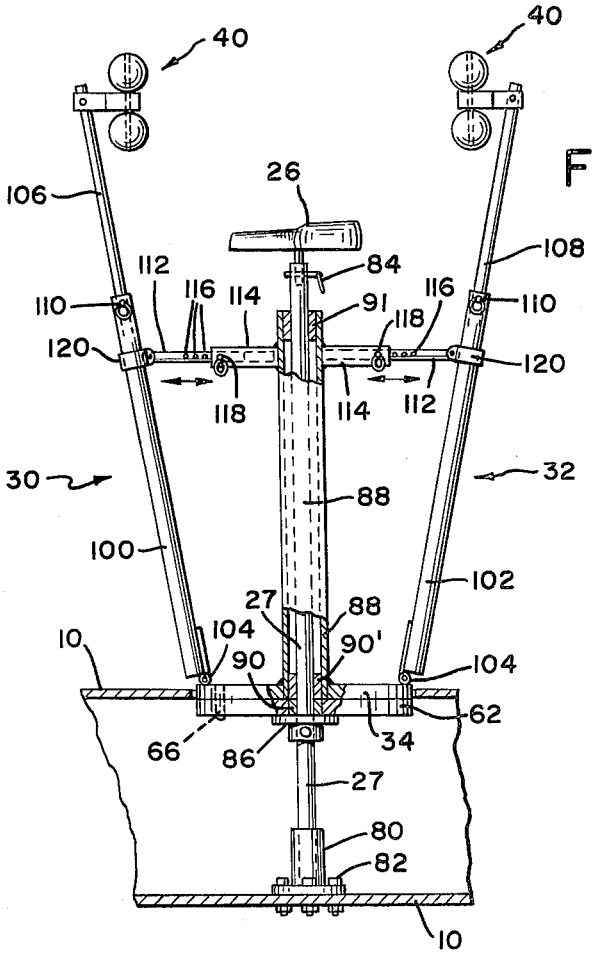
FIG. 4 is an elevational view, partly in section, showing the seat and the arms with massaging elements.

Referring now to FIGS. 2 and 4 in particular, it will be seen that the seat 26 is supported from the shaft 27 which rests at its lower end in a flange 80 fastened to the support 10 by suitable screw means 82. The height of the seat is adjustable by a suitable pin and hole arrangement 84 as is well known in the art. The drive plate 62 is supported by a thrust bearing 86. The plate 62 is fitted with a cylindrical bearing 90. The upper rotatable plate 34 is fitted with a bearing bushing 90' and has a tubing 88 welded to it for rotation with the plate 34 about the stationary shaft 27. The arms 30 and 32 comprise a lower tubing 100 and 102, each being fastened to the rotatable plate 34 by a hinge 104. In this manner the tubings 100 and 102 undergo reciprocating rotational motion in unison with the tubing 88 and the rotatable plate 34 which is driven by the plate 62 from the motion of the pedal shaft 18 via bar 54, coupling rod 56, universal joint 58 and vertical pin 60. Each of the tubings 100 and 102 is fitted with an inner rod 106 and 108, each rod telescopically engaging the respective tubing 100 or 102. By means of a suitable pin and aperture arrangement 110 the height of the massaging means 40 relative to the seat 26, and, therefore, along the torso of the person sitting on the seat 26 is adjustible. The arms 30 and 32 are supported, furthermore, along tubing 88 by means of a pin and sleeve combination 112 and 114 so as to improve rigidity. The pin 112 is provided with a plurality of apertures 116 to be engaged by a smaller pin 118 for providing adjustment of the distance between the massaging means and the vertical axis through the seat 26. This adjustment, of course, provides for adjusting the distance between the torso of the person and the massaging means 40. As clearly illustrated, both the vertical height of the massaging means along the torso of the person and the horizontal distance of the massaging means relative to the seat is adjustable as is necessary in order to accommodate the varied shapes of persons operating the present apparatus.

Figure 5:
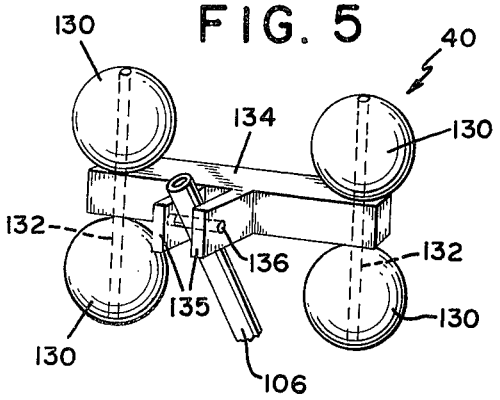
FIG. 5 is a perspective view showing the mounting of the massaging elements.

Instead of the fixed adjustment of the arms by virtue of the apertures 116 and the pin 118, it will be apparent that the hinges 104 may be provided with torsion springs so as to urge the arms 30 and 32 inwardly, that is toward the seat. Alternatively, the pin 112 may be replaced by a helical tension spring fastened to the clamp 120 and terminating with the other end inside the sleeve 114. In this manner the arms also are urged toward the seat 26 and by virtue of the resilient springs, both arms adjust themselves automatically to the contour of the body of the person operating the apparatus. FIG. 5 shows a typical embodiment of the massaging means 40 which comprises in the present example a plurality of resilient spherical elements 130 which are mounted for rotation upon a shaft 132, the latter being supported by a T-shaped bracket 134. As illustrated, there are two massaging elements 130 mounted upon a respective shaft 132. It is apparent that the quantity of massaging elements 130 can be increased or decreased and that the bracket 134 may support one or more shafts 132, although two shafts 132 have been shown for illustrative purposes. The bracket 134 is mounted pivotally to the rod 106 using a pin 136 which fits through the ears 135 extending rearwardly from the bracket 134 over the outside of the bar 106. The same construction applies also to the massaging means mounted to bar 108. Hence, the massaging elements 130 are adapted to roll over the body of a person as well as tilt about a generally horizontally disposed axis through the center of pin 136. In this manner the massaging means are adapted to follow the contour of the person. To change the azimuth orientation of the massaging means, the operator grasps the sleeves 114, lifts the arms 30, 32, tubing 88 and plate 34 and re-indexes the pin 66 relative to a suitable aperture 64 in drive plate 62.

It will be evident that the present apparatus is characterzed by extreme simplicity in construction and provides utmost versatility for use as an exercise apparatus as well as an exercise and combined massaging apparatus with adjustment features to yield a uniquely adaptable device.

While there has been described and illustrated a preferred embodiment of my invention and several modifications thereof have been indicated, it will be apparent to those skilled in the art that various further changes and modifications may be made therein without deviating from the broad principle of this invention which shall be limited only by the scope of the appended claims.

What is claimed is:

1. An exercise and massaging apparatus comprising in combination:

a stationary support;

pedal means including a rotatable pedal shaft mounted to said shaft support;

a seat supported by said support;

an arm upstanding from said support and mounted for reciprocating rotational motion about a substantially vertical axis;

mounting means disposed at the upper portion of said arm for fastening thereto massaging means adapted to engage the torso of a person sitting on said seat, and drive means coupled between said pedal shaft and said arm for causing responsive to the operation of said pedal means and rotation of said pedal shaft said arm and massaging means to undergo reciprocating rotational motion.

2. An exercise and massaging apparatus comprising in combination:

a stationary support;

pedal means including a rotatable pedal shaft mounted to said support;

a seat supported by said support;

an arm upstanding from said support mounted for reciprocating rotational motion about a substantially vertical axis;

massaging means adapted to engage the torso of a person sitting on said seat disposed at the upper portion of said arm for motion with said arm, and drive means coupled between said pedal shaft and said arm for causing responsive to the operation of said pedal means said pedal shaft to rotate and said arm to undergo reciprocating rotational motion whereby said massaging means is adapted to roll reciprocatingly about an engaged torso portion.

3. An exercise and massaging apparatus as set forth in claim 2, said massaging means comprising a plurality of rotatably mounted massaging elements.

4. An exercise and massaging apparatus as set forth in claim 3, said massaging elements being mounted to a bracket pivotally mounted to said arm.

5. An exercise and massaging apparatus as set forth in claim 3, and additional means coacting with the upper end of said arm for adjustably setting the height of said massaging means along the torso of a person.

6. An exercise and massaging apparatus as set forth in claim 3, and means operatively coupled to said arm for adjusting the horizontal distance between said massaging elements and the vertical axis through said seat.

7. An exercise and massaging apparatus as set forth in claim 6, said means operatively coupled to said arm comprising resilient means.

8. An exercise and massaging apparatus as set forth in claim 2, said arm being fastened at its lower end to a rotatable plate, and means coupling said drive means to said plate for causing said plate to undergo reciprocating rotational motion about a substantially vertical axis.

9. An exercise and massaging apparatus as set forth in claim 8, said pedal shaft comprising a crank shaft, said drive means including a bar having a slot for engaging said crank shaft, a connecting rod coupled with one end to said bar and having at its other end a ball and socket joint, a first pin coupled with one end to said joint and with its other end to a radial location along the face of a horizontally disposed drive plate adapted to reciprocate about its center, and a second pin aperture means cooperatively disposed for coupling said drive plate to said rotatable plate having the lower end of said arm fastened thereto.

10. An exercise and massaging apparatus as set forth in claim 9, and means coupled for disengaging said bar from said crank shaft for uncoupling said arm from the motion of said pedal shaft.

11. An exercise and massaging apparatus as set forth in claim 10, said means for disengaging comprising lifting means attached to said bar.

12. An exercise and massaging apparatus as set forth in claim 9, said second pin and aperture means comprising indexing means for adjusting the azimuth position of said arm about the torso of a person disposed on said seat.

13. An exercise and massaging apparatus as set forth in claim 12, said seat being mounted to a post upstanding from said stationary support, and means disposed for adjusting the height of said seat relative to said support.

14. An exercise and massaging apparatus as set forth in claim 8, and pivotal mounting means disposed for fastening the lower end of said arm to said rotatable plate.

15. An exercise and massaging apparatus comprising in combination:

a stationary support;

pedal means including a rotatable pedal shaft mounted to said support;

a seat supported by said support;

a plurality of arms upstanding from said support and mounted for reciprocating rotational motion about a substantially vertical axis intersecting said seat; massaging means adapted to engage the torso of a person sitting on said seat disposed at the upper end of each of said arms, and drive means coupled between said pedal shaft and said arms for causing responsive to the operation of said pedal means said pedal shaft to rotate and said plurality of arms to undergo reciprocating rotational motion whereby said massaging means are adapted to move reciprocatingly about the engaged torso portion.

16. An exercise and massaging apparatus as set forth in claim 15, said plurality of arms comprising two arms disposed diametrically opposite to one another.

17. An exercise and massaging apparatus as set forth in claim 16, and means mounting said arms for causing said arms to be subjected to equal motion.

18. An exercise and massaging apparatus as set forth in claim 15, and including means for individually adjusting the distance between said respective massaging means and the torso of a person sitting on said seat.

19. An exercise and massaging apparatus as set forth in claim 15, and indexing means disposed for selectively setting the azimuth orientation of said arms relative to said seat.

20. An exercise and massaging apparatus as set forth in claim 15, said plurality of arms being coupled at their respective lower ends to a plate, and means coupling said plate to said drive means for causing said plate to undergo reciprocating rotational motion responsive to the operation of said pedal means and rotation of said pedal shaft.

21. An exercise and massaging apparatus as set forth in claim 20, and means disposed for uncoupling the motion of said plate from the motion of said pedal shaft.

22. An exercise and massaging apparatus as set forth in claim 15, and brake means disposed for varying the effort required to rotate said pedal shaft when operating said pedal means.

23. An exercise and massaging apparatus as set forth in claim 2, and including means operatively associated with said drive means for uncoupling the motion of said pedal means from said arm.

24. An exercise and massaging apparatus as set forth in claim 23, said drive means including a bar having a slot for engaging a crank pin forming a part of said pedal shaft, and said means for uncoupling including means for lifting said bar from engagement with said pin and retaining said bar in disengaged position.

* * * * *